United States Patent [19]

Nelson

[11] 3,942,674

[45] Mar. 9, 1976

[54] ELECTRICAL GROUNDING FOR TANK FLOATING COVER

[76] Inventor: Ardell H. Nelson, 5701 Lost Forest No. 2202, Houston, Tex. 77018

[22] Filed: July 31, 1974

[21] Appl. No.: 493,321

[52] U.S. Cl. ..... 220/221; 174/2; 317/2 R
[51] Int. Cl.[2] ..... B65D 87/20; H05F 3/02
[58] Field of Search ..... 220/216–226, 220/88 R; 174/2, 5 SG; 124/6; 317/2 R

[56] References Cited

UNITED STATES PATENTS

| | | | |
|---|---|---|---|
| 1,121,057 | 12/1914 | Willcox et al. | 220/222 |
| 1,259,000 | 3/1918 | Dodd | 174/2 |
| 1,637,298 | 7/1927 | Garcia | 174/2 X |
| 2,735,573 | 2/1956 | Fino | 220/225 |
| 2,907,923 | 10/1959 | Short | 220/216 X |
| 2,914,212 | 11/1959 | Fino | 220/222 |
| 3,453,493 | 7/1969 | Goodwin, Jr. | 220/216 X |

*Primary Examiner*—William Price
*Assistant Examiner*—Stephen Marcus
*Attorney, Agent, or Firm*—Brown, Murray, Flick & Peckham

[57] ABSTRACT

A floating cover that is spaced inwardly from the side of an upright tank is electrically grounded to the tank by a plurality of cable loops disposed in substantially vertical planes around the cover and spanning the space between it and the tank side wall. One side of each loop is secured to the side of the cover while the opposite side of the loop engages the side of the tank. The loops are compressed laterally between the cover and the tank side wall to maintain sliding electrical contact with that wall as the cover moves in the tank.

3 Claims, 4 Drawing Figures

ELECTRICAL GROUNDING FOR TANK FLOATING COVER

A common way of electrically grounding a floating cover in a tank so that sparks caused by static electricity will not occur is to fasten one end of a metal cable to the cover and the other end of the cable to the bottom of the tank or to its roof if the tank has a roof. Such a system is satisfactory electrically, but as the cover moves up and down in the tank with changing liquid levels the necessary slack in the cable to permit this movement sometimes causes it to kink or become twisted in such a manner that it cannot be fully extended when necessary. This can result in a floating cover being prevented from rising with the rising liquid level or it may cause the cover to tilt as the liquid level rises or falls in the tank.

Grounding has also been accomplished by attaching metal strips to the cover, with the outer ends of the strips engaging the surrounding wall of the tank. Such strips may catch on projections from the side of the tank. If the cover turns in the tank, as sometimes happens, some of the strips may be bent laterally permanently so that they will not engage the tank when the cover floats toward the opposite side of the tank.

It is among the objects of this invention to provide the floating cover of an upright tank with grounding devices which are very flexible, which are inexpensive and durable, which will always remain in engagement with the side of the tank regardless of the position of the cover, and which cannot be bent out of shape permanently.

The preferred embodiment of the invention is illustrated in the accompanying drawing, in which FIG. 1 is a fragmentary plan view of a floating cover in a tank shown in section;

Figure 1:
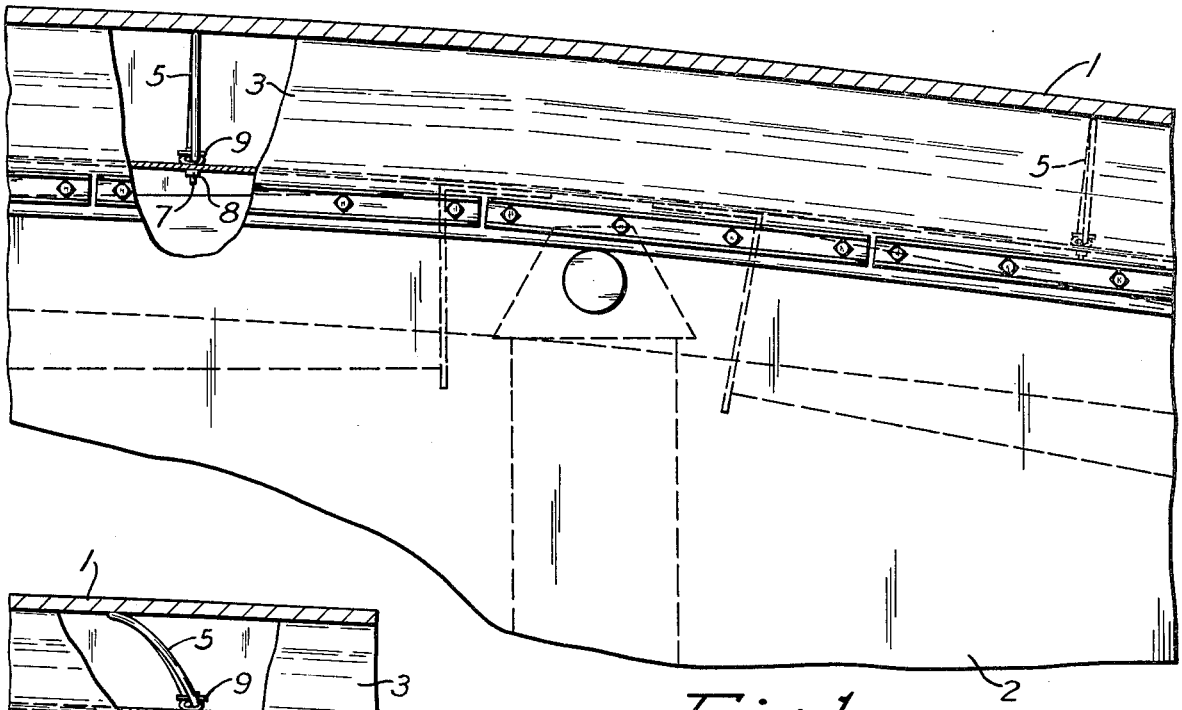
Figure 2:
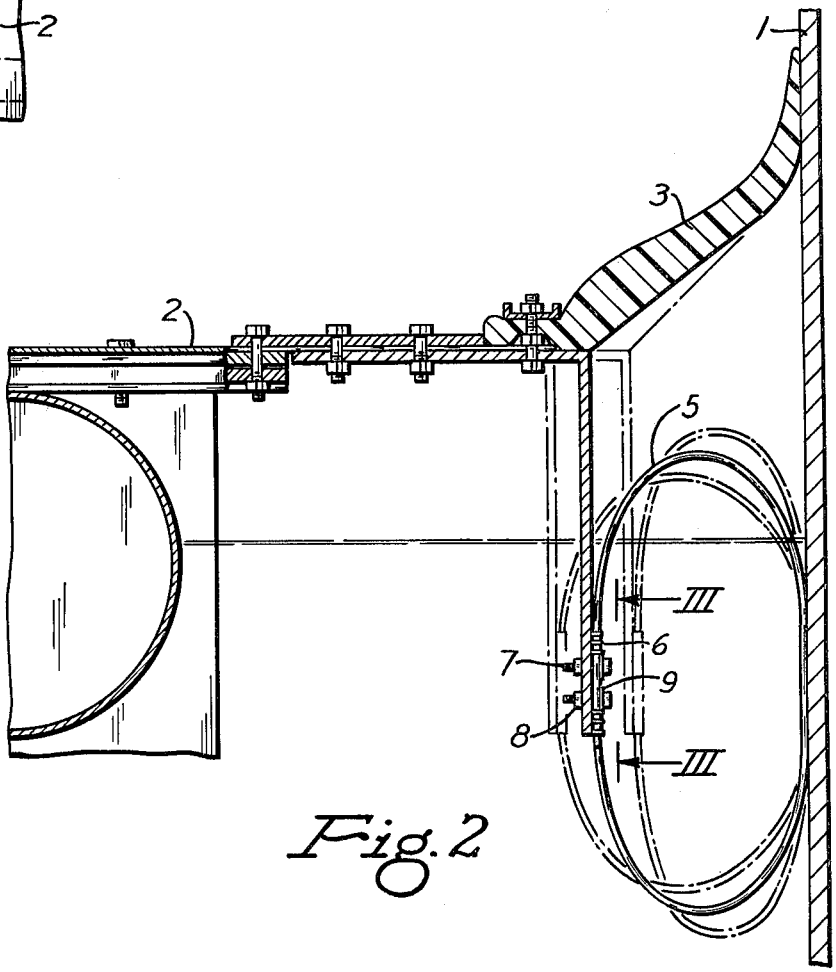
FIG. 2 is an enlarged fragmentary vertical section showing a side view of a grounding device.

Referring to FIGS. 1 and 2 of the drawings, an upright tank that may or may not have a roof has a bottom and a vertical side wall 1. Generally, the tank will be cylindrical but it can be some other shape as long as its side wall is vertical. Inside the tank there is a floating cover 2 of any suitable construction, many forms of which are well-known, that floats on the liquid in the tank and rises and falls with the liquid level. The diameter of the cover is somewhat less than the diameter of the tank so that when the cover is centered in the tank the side of the cover will be spaced from the side of the tank. The top of the annular space thus formed between the cover and tank is closed by a flexible sealing strip 3 clamped to the edge of the cover and extending outwardly and upwardly into sliding engagement with the side of the tank. Preferably, the cover has an encircling side wall that extends down into the liquid below.

Figure 3:
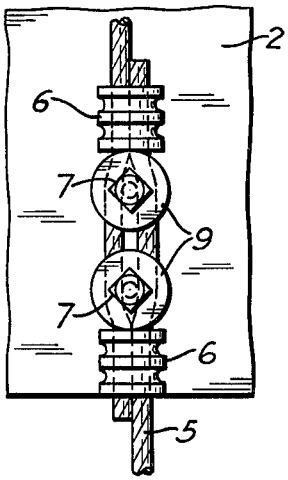
FIG. 3 is an enlarged view taken on the line III—III of FIG. 2.

It is a feature of this invention that means are provided for electrically grounding the cover to the tank to prevent the buildup of static electricity that might cause an electric spark, which could ignite the contents of the tank or even cause an explosion. Accordingly, the cover is surrounded by several electrical conducting loops spaced uniformly around it. As shown in FIGS. 1 and 2, each loop is formed from a metal cable 5 and is disposed in a substantially vertical plane between the side of the cover and the side of the tank. The loops span the annular space between the cover and the surrounding side wall of the tank. In a circular tank the planes of the loops are disposed substantially radially of the tank and the cover when the cover is centered in the tank. Each loop is formed by overlapping the opposite ends of a length of cable for several inches. These overlapping end portions are secured rigidly together by any suitable means spaced apart vertically, such as by a pair of sleeves 6 surrounding them and compressed tightly against the cable to hold its end portions together as shown in FIG. 3. The overlapping end portions of the cable between the sleeves are clamped against the side wall of the cover by fastening members, such as by bolts 7 extending between the overlapping ends and through holes in the cover. Nuts 8 (FIG. 2) are mounted on the inner ends of the bolts and tightened against the inner side of the cover side wall. Washers 9 between the heads of the bolts and the cable clamp it tightly against the cover.

The cable loops, before they are attached to the cover, are substantially circular and their diameter is greater than the widest space that can be formed between the floating cover and the side wall of the tank if the cover floats toward one side of the tank. Therefore, when the loops are attached to the cover they are cmmpressed laterally or horizontally between the cover and the side of the tank and are elongated vertically as shown in FIG. 2. This provides a substantial length of contact between the loops and the side of the tank. This contact is maintained by the pressure of the loops against the tank, due to their tendency to expand to circular form. As the cover rises and falls in the tank, the loops slide up and down the inner surface of the tank and maintain the cover electrically connected to the tank. In case the cover floats toward one side of the tank, the loops at that side will be compressed more but at the opposite side they will expand a like amount and still remain in engagement with the side of the tank. This action of the loops is indicated in dotted lines in FIG. 2. The loops, being made from a flexible cable, do not take a permanent bend or set position, so that when the cover floats back toward the opposite side of the tank the highly compressed loops will expand and remain in contact with the side of the tank.

Although the loops can be made from a solid single wire cable, it is preferred to make them from a cable that has been formed from a plurality of twisted wire strands, because such a cable is more flexible and resilient.

Figure 4:
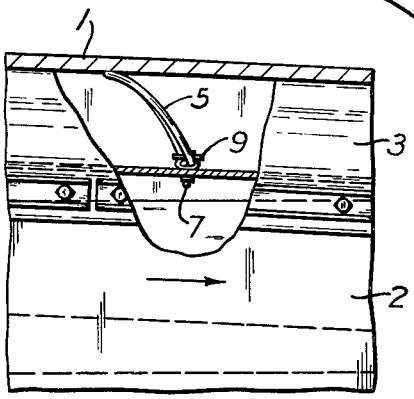
FIG. 4 is a view similar to FIG. 1, but showing the cover rotated a few degrees in the tank.

Another advantage of these grounding loops is that if a cover floats toward one side of the tank and at the same time rotates on its axis, the loop or loops at the nearest side of the tank can be swung into lateral positions where they will extend in a generally circumferencial direction relative to the tank and cover, as shown in FIG. 4. This lateral swinging or twisting of the loops does not affect them permanently. As the cover floats away from that side of the tank, the loops will move back toward their normal radial position without becoming disengaged from the side of the tank.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In an upright tank, a floating cover spaced inwardly from the side of the tank and movable therein in vertical, horizontal and circumferential directions, a flexible sealing ring encircling the cover and secured thereto, the outer edge of the sealing ring slidably engaging the tank side wall, a cable loop disposed between the cover and the tank side wall and spanning the space between them, said loop being spaced vertically from the sealing ring, and means securing one side of the loop to the side of the cover, the opposite side of the loop engaging the tank side wall, and the loop always being compressed laterally between the cover and the side of the tank as the cover moves in the tank in any of said directions, whereby the loop maintains electrical contact with said side wall.

2. In an upright tank, a floating cover spaced inwardly from the side of the tank and movable therein in vertical, horizontal and circumferential directions, a flexible sealing ring encircling the cover and secured thereto, the outer edge of the sealing ring slidably engaging the tank side wall, a plurality of flexible cable loops disposed in substantially vertical planes around said cover between it and the tank side wall and spanning the space between them, said loops being spaced vertically from the sealing ring, and means securing one side of each loop to the side of the cover, the opposite side of each loop engaging the tank side wall, and the loops being compressed laterally between the cover and the side of the tank to maintain sliding electrical contact with said side wall as the cover moves in the tank in any of said directions.

3. In a tank according to claim 2, the uncompressed width of each of said loops being greater than the maximum distance between said cover and the side of the tank when the cover is as close to one side of the tank as it is possible to be.

* * * * *